US011199058B2

(12) United States Patent
Amorim et al.

(10) Patent No.: US 11,199,058 B2
(45) Date of Patent: Dec. 14, 2021

(54) TOP CONNECTIONS OF SUBSEA RISERS

(71) Applicant: Subsea 7 do Brasil Servicos Ltda, Niteroi (BR)

(72) Inventors: Andre Ramiro Amorim, Rio de Janeiro (BR); Gustavo Queiroz Hepner, Katy, TX (US); Luiz Carlos de Lemos Junior, Rio de Janeiro (BR)

(73) Assignee: Subsea 7 do Brasil Servicos Ltda, Niteroi (BR)

( * ) Notice: Subject to any disclaimer, the term of this patent is extended or adjusted under 35 U.S.C. 154(b) by 0 days.

(21) Appl. No.: 16/868,601

(22) Filed: May 7, 2020

(65) Prior Publication Data

US 2021/0348455 A1 Nov. 11, 2021

(51) Int. Cl.
*E21B 17/01* (2006.01)
*E21B 19/00* (2006.01)

(52) U.S. Cl.
CPC ..... *E21B 19/006* (2013.01); *E21B 17/01* (2013.01)

(58) Field of Classification Search
CPC ..... E21B 17/01; E21B 17/015; E21B 17/017; E21B 19/004; E21B 19/006
See application file for complete search history.

(56) References Cited

U.S. PATENT DOCUMENTS 3,378,067 A * 4/1968 Leonard ..... E21B 43/01 166/350
3,487,486 A * 1/1970 Terry ..... B63B 22/06 441/29
5,269,629 A 12/1993 Langner
5,865,566 A 2/1999 Finn
8,550,171 B2 10/2013 Wajnikonis et al.
9,988,860 B2 * 6/2018 Salem ..... E21B 19/004
2019/0032428 A1 1/2019 Askestad

FOREIGN PATENT DOCUMENTS

BR PI0505400 9/2007
BR PI0601788 1/2008
KR 20150057685 5/2015
(Continued)

OTHER PUBLICATIONS

API Specification 5L, "Specification for Line Pipe," 45th ed. 2012.
(Continued)

*Primary Examiner* — Matthew R Buck
(74) *Attorney, Agent, or Firm* — Levy & Grandinetti

(57) ABSTRACT

A top connection arrangement for a subsea riser comprises a pivot or joint combination disposed between, and fluidly connecting, upper and lower sections of rigid pipe. The pivot combination comprises an upper ball joint about which the upper pipe section is pivotable. A lower joint, being a flexible joint or a tapered stress joint to which the lower pipe section is attached, is fixed to the ball joint in series.

A sleeve is fixed to the ball joint and surrounds the upper pipe section to permit limited pivotal movement of that pipe section about the ball joint. The sleeve may seat into the bellmouth of an I- or J-tube of a surface facility or may be omitted if the lower joint is seated in a hang-off formation.

A locking mechanism is capable of locking the ball joint and hence preventing pivotal movement of the upper pipe section.

29 Claims, 5 Drawing Sheets

(56) References Cited

FOREIGN PATENT DOCUMENTS

| | | |
|---|---|---|
| WO | WO 2009/108644 | 9/2009 |
| WO | WO 2010/025449 | 3/2010 |
| WO | WO 2011/008704 | 1/2011 |
| WO | WO 2016/028792 | 2/2016 |
| WO | WO 2016/191637 | 12/2016 |

OTHER PUBLICATIONS

API Recommended Practice 1111, "Design, Construction, Operation, and Maintenance of Offshore Hydrocarbon Pipelines (Limit State Design)," 5th ed. 2015.
ANSI/API Specification 17J, "Specification for Unbonded Flexible Pipe," 3d ed. 2008.
API Recommended Practice 17B, "Recommended Practice for Flexible Pipe," 5th ed. 2014.

* cited by examiner

TOP CONNECTIONS OF SUBSEA RISERS

This invention relates to subsea risers as used in the offshore oil and gas industry to convey hydrocarbons and sometimes other fluids from the seabed to the surface. Risers may also be used reciprocally to convey other fluids, power and data from the surface to the seabed.

Riser configurations include those known in the art as free-hanging, steep, lazy-wave and weight-distributed risers. Such risers are typically suspended between a floating upper support and the seabed, the upper support being a surface facility such as a platform, a floating production unit (FPU) or an FPSO (floating production, storage and offloading) vessel.

A common free-hanging riser comprises a rigid pipe that hangs freely as a catenary from the surface facility. Most conventionally, such a riser is of steel—hence being known in the art as a steel catenary riser or SCR.

Those skilled in the art know that nominally rigid pipes are not devoid of flexibility. Indeed, SCRs exploit the bending behaviour of rigid pipes in the elastic domain. However, whilst they have flexibility, 'rigid' pipes do not fall within the definition of 'flexible' pipes as understood in the art.

Conventional rigid pipes used in the subsea oil and gas industry are specified in the American Petroleum Institute (API) Specification 5L and Recommended Practice 1111. A rigid pipe usually consists of, or comprises, at least one pipe of solid steel or steel alloy. However, additional layers of other materials can be added, such as an internal liner layer or an outer coating layer. A rigid pipe may also have a concentric pipe-in-pipe (PiP) structure. Rigid pipe joints are terminated by a bevel, a thread or a flange, and are assembled end-to-end by welding, screwing or bolting them together to form a pipe string or pipeline.

Conversely, flexible pipes used in the subsea oil and gas industry are specified in API Specification 17J and Recommended Practice 178. The pipe body is composed of a composite structure of layered materials, in which each layer has its own function. In particular, bonded flexible pipes comprise bonded-together layers of steel, fabric and elastomer and are manufactured in short lengths in the order of tens of metres.

Typically, polymer tubes and wraps ensure fluid-tightness and thermal insulation, whereas steel layers or elements provide mechanical strength.

In recent years, the subsea oil and gas industry has begun to adopt rigid pipes of polymer composite materials in place of steel. Composite pipes have a tubular load-bearing structure that is principally of composite materials. This is to be distinguished from pipes having a composite structure, such as the various layered configurations of rigid and flexible pipes as mentioned above.

Typically, a composite pipe comprises a polymer resin matrix reinforced by fibres such as glass fibres or carbon fibres. The polymer matrix may be of thermoplastic or thermoset materials. The former results in what is known in the art as thermoplastic composite pipe or, more simply, as thermo-composite pipe (TCP). TCP Is classed as a bonded composite pipe.

A riser typically has negative buoyancy in seawater and so is held in tension by its suspended apparent weight. That weight, expressed in the art as top tension, is suspended from a supporting structure on a surface facility.

FIG. 1 exemplifies a supporting structure 10 that is cantilevered from the side of an FPSO 12. In the case of an FPSO 12, the supporting structure 10 commonly comprises a lower balcony 14 and an upper balcony 16 above and spaced vertically from the lower balcony 14. The vertical spacing between the lower balcony 14 and the upper balcony 16 is typically between about 10 m and about 30 m.

During installation, a riser is puled into engagement with the supporting structure 10 and is then locked to the structure 10 via a fatigue-resistant element. Typically, the fatigue-resistant element is a bend stiffener for flexible risers or a flexible joint element for rigid risers.

A conventional installation method involves pulling top elements of the riser, such as a head, connector, bend stiffener or stress joint, through a tube or hang-off formation of the supporting structure and then locking the fatigue-resistant element into the tube or hang-off formation. For example, some risers extend along an I-tube or J-tube of a supporting structure, depending on the shape of the tube.

The supporting structure 10 shown in FIG. 1 comprises an I-tube 18. The bottom of the I-tube 18 comprises a bellmouth 20 that is inclined to the vertical to suit the operational inclination of the top of the riser. During pull-in, as the riser is pulled up the I-tube 18, a bend stiffener on the riser is received by and locked into the bellmouth 20. For other risers, a flexible joint may be seated into a hang-off formation.

A spool pipe in fluid communication with the top of a riser may be supported by, and extend between, the lower balcony and the upper balcony. Above the upper balcony, the spool pipe connects the riser to pipework aboard the surface facility, for example to convey hydrocarbon production fluids from the riser for processing and storage.

The top of a suspended riser naturally adopts an angle to the vertical when positioned for operation. The supporting structure of the surface facility is designed to comply with that angle. However, transiently, the top of the riser adopts different or greater angles to the vertical during installation. In particular, the angle of the top of the riser varies during the steps of: pulling; passage into and locking to the tube, or seating into the hang-off; and connection to topside process piping aboard the surface facility.

Once installed, a riser will be in motion throughout its operational life. Its motion is driven by multiple inputs arising from sea dynamics, most notably motion of the surface facility expressed as heave, pitch, roll and yaw, and seawater motion caused by currents, tides and waves. Consequently, the riser is connected at its upper end to the supporting structure by a connection device that provides some degrees of freedom, examples being a stress joint or a flexible joint or pivot as described in WO 2010/025449.

The term 'flexible joint' typically designates a particular category of pivot comprising at least one supporting elastomeric element that facilitates rotation of piping sections. Examples of flexible joints are manufactured and sold by Oil States Industries and Techlam Hutchinson.

Such a joint allows the riser to pivot freely relative to the supporting structure about mutually orthogonal, substantially horizontal axes. Thus, as the riser bends along its length under the influence of sea dynamics, the top of the riser can pivot relative to the supporting structure within a downwardly-diverging cone whose apex coincides with the centre of pivotal rotation of the joint. In some cases, the riser may also be able to twist or turn about its longitudinal axis relative to the supporting structure.

Usually for a SCR, the top connector is a flexible joint or stress joint that accommodates the conical angle of the riser at the balcony. Both solutions consider a flexible pipe connected to the top of joint to transfer fluids to or from topside processing equipment.

There is a need to handle conflicting requirements during installation and operation of a riser, namely: transient but substantial variations in the bending angle during installation and pulling of the top of the riser; followed by more limited but frequent ongoing variations in the bending angle during operation of the riser. The latter motions generate a variable bending moment over repeated cycles and so promote fatigue at the top of the riser.

A limited bending angle is sufficient in operational conditions where fatigue is the driving factor. However, a greater bending angle is needed for connection to the rigid supporting structure of the surface facility. The challenge is to accommodate substantial variations in the bending angle during installation but without sacrificing fatigue performance during operation.

In this respect, flexible joints and swivels are well known in the art for compensating for operational bending at the top of a riser but they are less able to accommodate bending angles that may be encountered during installation. Conversely, joints that can handle greater bending angles usually suffer from inferior fatigue performance.

A flexible joint often comprises an elastomeric element, as disclosed in U.S. Pat. No. 5,269,629 or WO 2016/028792. Conversely, WO 06/3598 discloses a gimballing SCR hang-off and BR PI0505400 discloses a bell swivel as an alternative to a flexible joint. The ball swivel of BR PI0505400 comprises a half-sphere that can rotate within a complementary seat of a hang-off structure.

U.S. Pat. No. 5,865,566 shows a typical use of a flexible joint, locked into the entry or bellmouth of a J-tube along which the riser extends. Here, the pipe comprises a ball valve to isolate the riser.

In WO 2009/108644, two flexible joints are combined head-to-head. Two flexible joints are also combined in WO 2011/008704. This arrangement provides greater bending capacity than a single flexible joint while keeping the advantages inherent to flexible joints, notably their resistance to fatigue. However, flexible joints are extremely expensive.

Additional flexibility is often provided by adding a flexible pipe, known as a flexible spool, between the top end of the riser and topside process pipework aboard the surface facility. This is not satisfactory because flexible pipe is more expensive than rigid pipe; also, flexible pipe is weaker than rigid pipe and so is the weakest mechanical link between the riser and the pipework of the surface facility. Handling and connecting a flexible part overboard along the hull of the surface facility is also a risky operation.

Alternative arrangements are known with the same purpose as a flexible pipe. For example, WO 2016/191637 and U.S. Pat. No. 8,550,171 describe riser top connections that comprise a swivel, typically a flexible joint, set into a hang-off receptacle that is surmounted by a rigid spool. The rigid spool is shaped to confer flexibility on the spool to bend along its length, for example by being coded or otherwise bent in a transverse plane. Similarly, KR 20150057685 discloses a convoluted shock absorber formation of the riser in combination with a flexible hang-off.

In BR PI0601788, a tapered joint for resistance to fatigue and a flexible joint for bending are combined.

US 2019/032428 places a flexible joint or ball joint between two sections of rigid pipe. However, that arrangement does not provide enough flexibility for pulling the riser through a broad range of tubes or hang-offs. In this respect, flexible joints have limited pivot angles whereas ball joints allow a greater bending angle but have less resistance to fatigue.

Against this background, the invention may be defined as a top connection arrangement for a subsea riser. The arrangement comprises a pivot combination disposed between, and fluidly connecting, upper and lower pipe sections of rigid pipe. The pivot combination comprises: an upper ball joint to which the upper pipe section is attached and about which the upper pipe section is pivotable; and a lower joint fixed to the ball joint in series, the lower joint being a flexible joint or a tapered stress joint to which the lower pipe section is attached.

The arrangement may further comprise a sleeve that is fixed to the ball joint and that surrounds the upper pipe section. An annular gap between the sleeve and the upper pipe section permits pivotal movement of the upper pipe section about the ball joint. The sleeve may also limit further pivotal movement of the upper pipe section about the ball joint. An outer face of the sleeve suitably comprises an upwardly-tapering mating formation.

The bell joint is preferably attached directly to the lower joint to form a compact, rigid unit. In some embodiments, a flange adapter may interconnect respective flanges of the ball joint and of the lower joint.

For hang-off purposes, the upper pipe section may comprise a load-bearing formation spaced longitudinally from, and tapering toward, the ball joint.

The bell joint may comprise a locking mechanism that is capable of locking the ball joint against movement of the upper pipe section relative to the ball joint and relative to other elements of the arrangement. For example, the locking mechanism may comprise a circumferential array of dogs or like elements disposed around a central pivot element. In that case, the dogs may be movable radially inwardly to engage the pivot element to lock the ball joint. To accommodate any inclination of the pivot element, the dogs are suitably movable radially inwardly to respectively different extents.

The inventive concept also embraces the arrangement of the invention when supported by a supporting structure of a surface facility. For example, the supporting structure may comprise a hang-off formation in which the lower joint is seated, or the lower joint may be engaged with the supporting structure via the ball joint.

Where the ball joint is fitted with the aforementioned sleeve, the sleeve may be received in a bellmouth defined by a tubular support of the supporting structure, in particular an I-tube or a J-tube. Elegantly, in that case, tension in the upper pipe section may retain the sleeve in the bellmouth.

The arrangement of the invention may be used to support a catenary-type riser of rigid pipe or flexible pipe. In some embodiments, tension in the upper pipe section may support the suspended weight of the riser.

Advantageously, the upper pipe section may be in fluid communication with pipework of the surface facility without the need for an intermediate flexible conduit.

The inventive concept also embraces a surface facility when supporting the arrangement of the invention.

The inventive concept extends to a corresponding method of connecting a subsea riser to a surface facility. The method comprises: pulling in a top connection arrangement of the riser toward engagement with a supporting structure of the surface facility; while pulling in, pivoting an upper rigid pipe section of the arrangement about an upper ball joint of the arrangement; engaging a lower joint of the arrangement with the supporting structure, that lower joint being a flexible joint or a tapered stress joint fixed in series to the bell joint; suspending the riser from the surface facility via a lower rigid pipe section of the arrangement that is attached to the lower joint engaged with the supporting structure, and effecting fluid communication between the upper rigid pipe section and pipework aboard the surface facility.

The ball joint may be locked to restrain further pivoting of the upper rigid pipe section. The lower rigid pipe section may also be pivoted about the lower joint while puling in the arrangement.

The lower joint may be engaged with a hang-off formation of the supporting structure. Alternatively, the lower joint may be engaged with a bellmouth of a tube, most conveniently after pulling the upper rigid pipe section into that tube. The lower joint may then be held in engagement with the bellmouth by tension in the upper rigid pipe section. More generally, the upper rigid pipe section may be engaged with a hang-off formation of the supporting structure, enabling the weight of the riser to be suspended through the upper rigid pipe section.

The lower joint may be engaged with the bellmouth via the ball joint, for example via a sleeve attached to the ball joint. The sleeve may be used to limit pivotal movement of the upper rigid pipe about the ball joint.

Prior art such as US 2019/032428 comprises only one type of pivot. In contrast, the inventive concept involves a series connection between two pivots with different but complementary characteristics. Specifically, one pivot, typically a ball joint, has high flexibility to accommodate large bending angles but low resistance to fatigue and so may be used only or principally for installation of the riser. The other pivot, typically a flexible joint containing an elastomeric element, allows smaller bending angles but has good long-term resistance to fatigue and so may be used only or principally for operation of the riser.

Thus, the invention provides an alternative solution for rigid riser connection to a balcony of a surface facility such as a floating production unit. The invention is designed for flexible pipes or to hang off a rigid pipe by substituting a rigid spool for a flexible spool above a lower balcony.

The standard and field-proven solutions for rigid and flexible risers include free hanging catenaries, lazy wave risers, weight-distributed risers and other configurations. For some projects, these solutions are not viable or lead to a substantial increase in the field development cost. For other scenarios where the riser balcony of a surface facility is used for flexible pipe only and a rigid riser solution is required, known solutions for top connectors are not technically or financially practicable. The invention provides a new concept for a riser top connector to accommodate these scenarios and to address these challenges.

As noted above, a flexible riser is installed through the bellmouth of an I- or J-tube extending up from the lower balcony to the upper balcony. There is a difference in angle at the lower balcony relative to the upper balcony. This is due to the top angle of the catenary at the lower balcony usually being between 5° and 9° to the vertical, typically about 8°, whereas the riser is substantially vertical at the upper balcony, as shown in FIG. 1. This difference in angle is a challenge if it is preferred to use a rigid spool above the riser. Consequently, the invention contemplates a rigid angular connection to meet this challenge and also, potentially, to allow a rigid SCR to be installed to a flexible riser balcony.

The system of the invention provides a total rigid pipe solution for risers in case of any problem with flexible riser elements, whatever flexible riser solution may have been employed. In addition to steel risers, the invention may be applied to risers of TCP, of standard flexible pipe, of lined pipe and so on. The system of the invention is also suitable for different riser configurations, for example buoyancy-supported risers (BSRs), hybrid riser towers (HRTs) and indeed any decoupled riser solutions.

The system of the invention allows for a pre-abandonment scenario and can be used in combination with a pipeline and riser (PLR), if needed. Optionally, a locking tool may be provided to prevent large angles arising during pipe recovery.

Embodiments of the invention provide a riser top connection section, comprising at least, from top to bottom: a lower rigid pipe section; a flexible joint; a ball joint connected in series with the flexible joint; and an upper rigid pipe section. Each of those elements may have at least one flange at an end for end-to-end interconnection to at least one neighbouring element. The invention may be used with a rigid riser such as a steel catenary riser or a flexible riser.

The riser top connection section may comprise a sleeve called a 'bishop hat' that can slide around the upper rigid pipe section and mechanically connect to the ball joint and to an external support. The sleeve limits bending of the ball joint.

More generally, therefore, the ball joint can be mechanically connected to an external support. The flexible joint can also be mechanically connected to an external support. The external support could be a tube or a seat or a support of a balcony of a surface facility that supports the riser.

The facing flanges of the ball joint and the flexible joint may be reinforced by a mechanically connected flange adapter between them.

The ball joint angle may be lockable after installation, for example using a cylinder system that actuates an array of dogs, pawls or other locking mechanisms.

Conveniently, the upper rigid pipe section can be directly connected to pipework of the surface facility without needing a flexible spool.

Embodiments of the invention also implement a method to connect to a surface facility a catenary-type riser for transporting a fluid between the seabed and the surface facility. That method comprises: providing a riser top comprising an upper rigid section, a bell joint, a flexible joint in series with the ball joint and a lower rigid section; pulling the riser top through a connection means of the surface facility while the ball joint and the flexible joint pivot; locking the upper rigid section and the ball joint or the flexible joint in position into the connection means; fluidly connecting the upper rigid section to the process piping of the surface facility; and allowing the flexible joint to rotate during operations. The bell joint angle may, conversely, be locked for operations.

In summary, the invention provides a top connection arrangement for a subsea riser comprises a pivot or joint combination disposed between, and fluidly connecting, upper and lower sections of rigid pipe. The pivot combination comprises an upper ball joint to which the upper pipe section is attached and about which the upper pipe section is pivotable. A lower joint, being a flexible joint or a tapered stress joint to which the lower pipe section is attached, is fixed to the bell joint in series.

A sleeve may be fixed to the ball joint and may surround the upper pipe section to permit limited pivotal movement of the upper pipe section about the bell joint. The sleeve can seat into the bellmouth of an I- or J-tube of a surface facility, or may be omitted if the lower joint is seated into a hang-off formation. A locking mechanism may be capable of locking the ball joint and hence preventing pivotal movement of the upper pipe section.

To put the invention into context, reference has already been made to FIG. 1, which is a partial end view of a riser supporting structure mounted on the side of an FPSO. In order that the invention may be more readily understood, reference will now be made, by way of example, to the remainder of the accompanying drawings in which.

Figure 5:
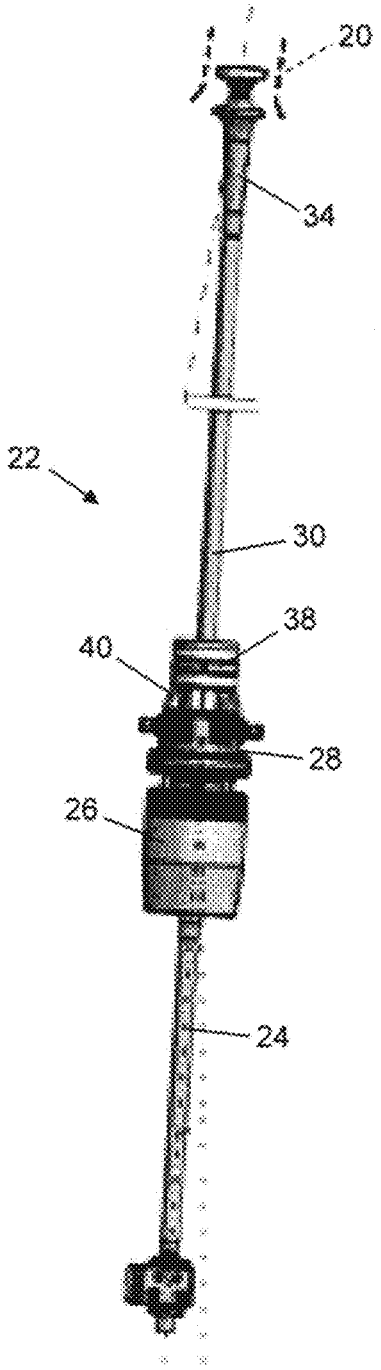
FIG. 5 is a side view of the arrangement of FIG. 2 when being pulled into an I-tube of a supporting structure during installation of a riser.
Figure 6:
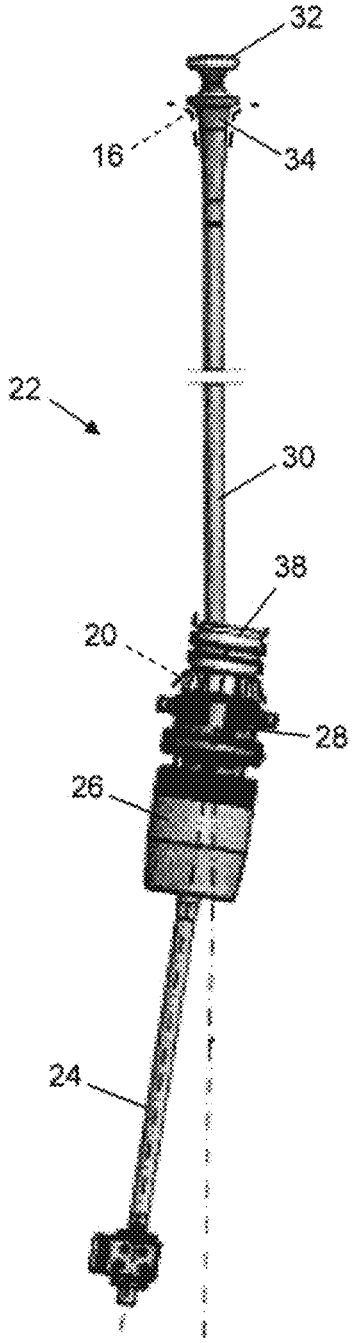
Figure 7:
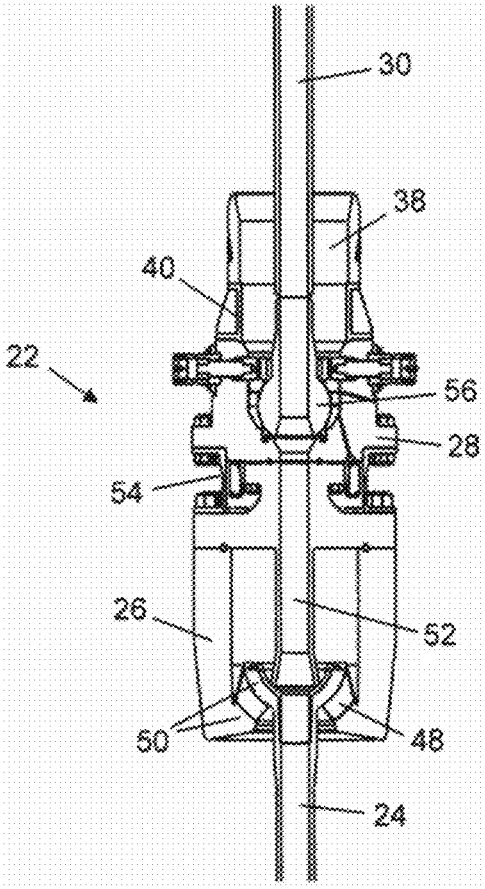
Figure 8:
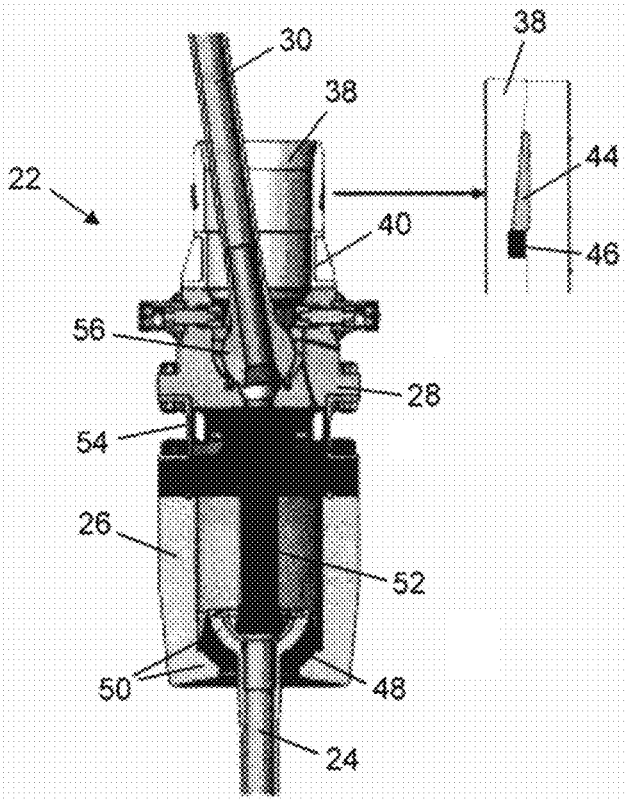
Figure 9:
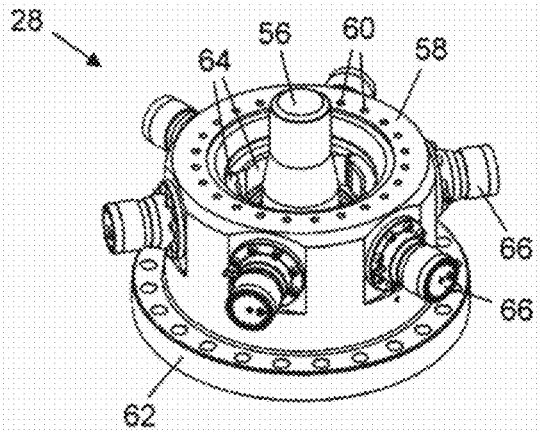
Figure 10:
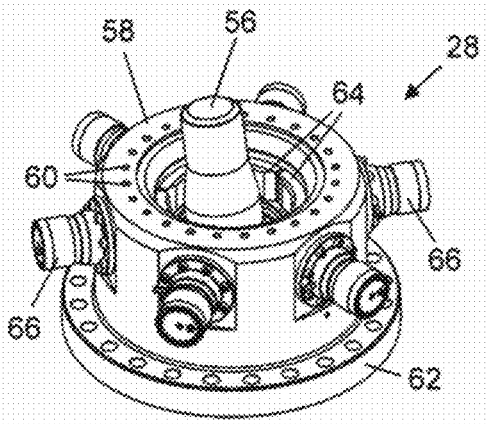
Figure 11:
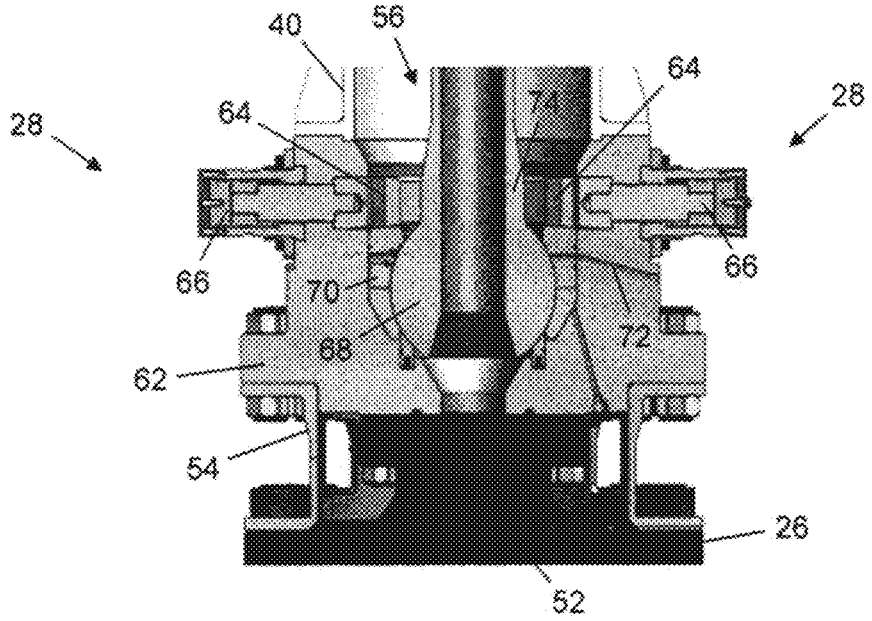
Figure 12:
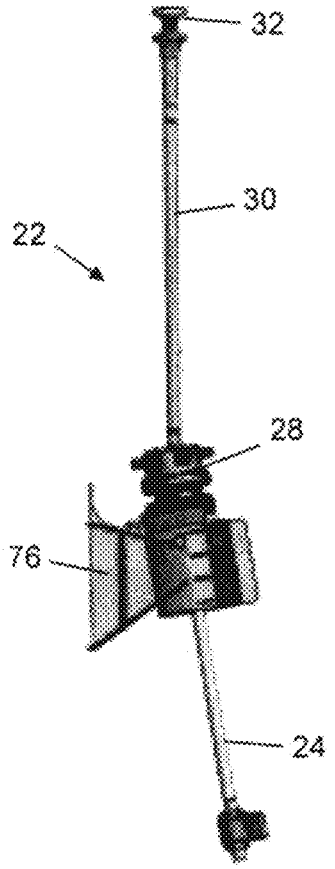
Figure 13:
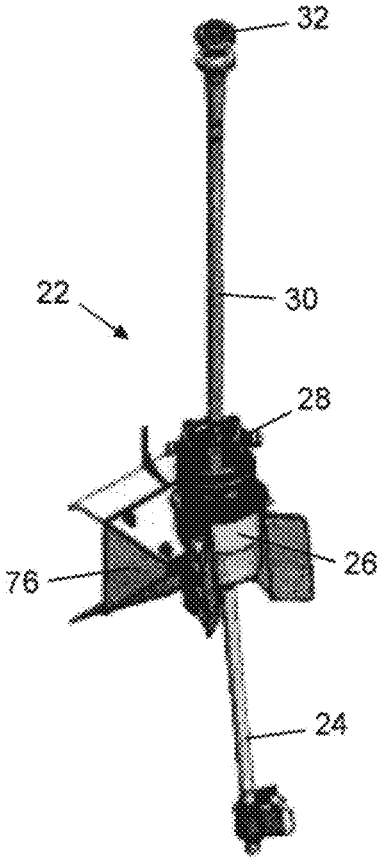

FIG. 6 corresponds to FIG. 5 but shows the arrangement now pulled in and engaged with a bellmouth of the I-tube;

FIG. 7 is a view in longitudinal section through the pivot combination of the arrangement, with the upper pipe in axial alignment with a lower rigid pipe of the arrangement;

FIG. 8 corresponds to FIG. 7 but shows the upper pipe of the arrangement pivoted away from the central longitudinal axis about the pivot axis of the bell joint:

FIGS. 9 and 10 are enlarged perspective views of the ball joint in the states shown in FIGS. 7 and 8 respectively;

FIG. 11 is an enlarged view in longitudinal section through a ball joint of the arrangement, mounted atop the flexible joint;

FIG. 12 is a side view of an alternative supporting structure, showing the flexible joint seated in a hang-off structure; and FIG. 13 is a perspective view corresponding to FIG. 12.

Figure 1:
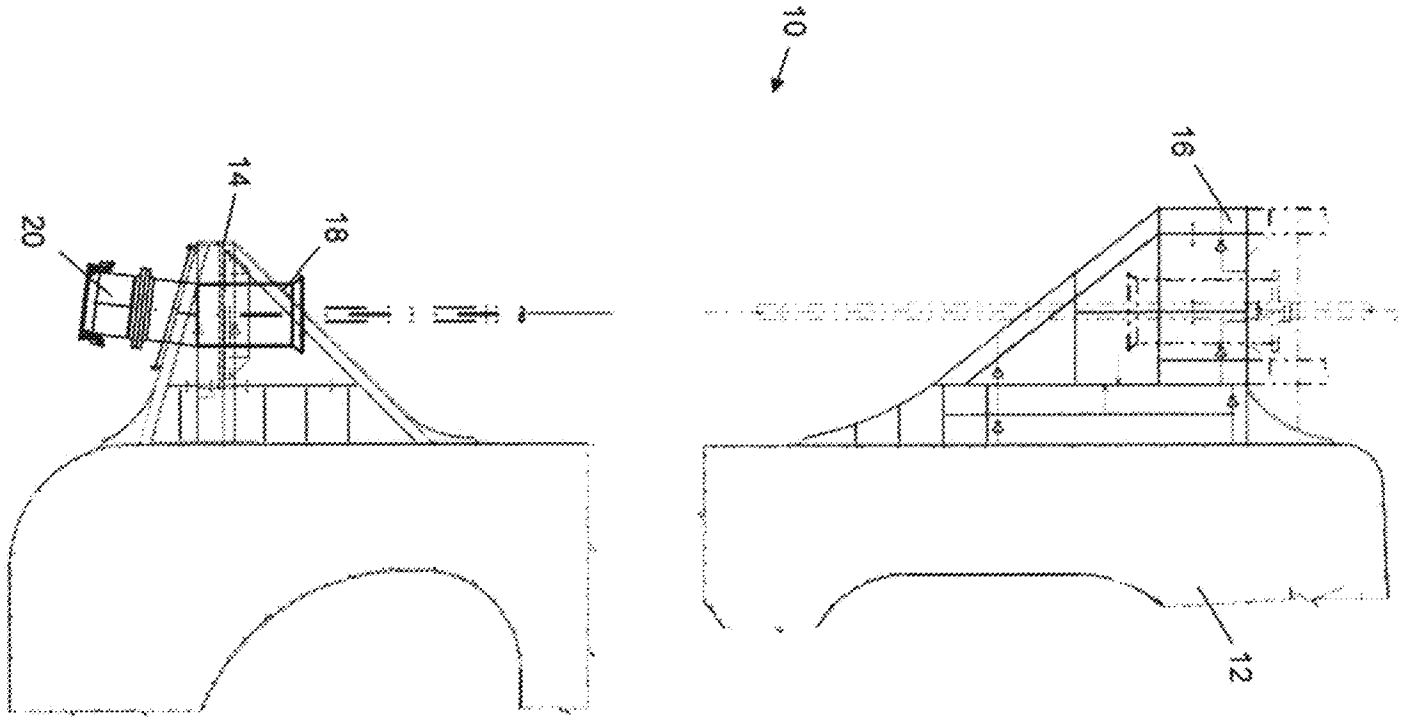
Figure 1 PRIOR ART
Figure 2:
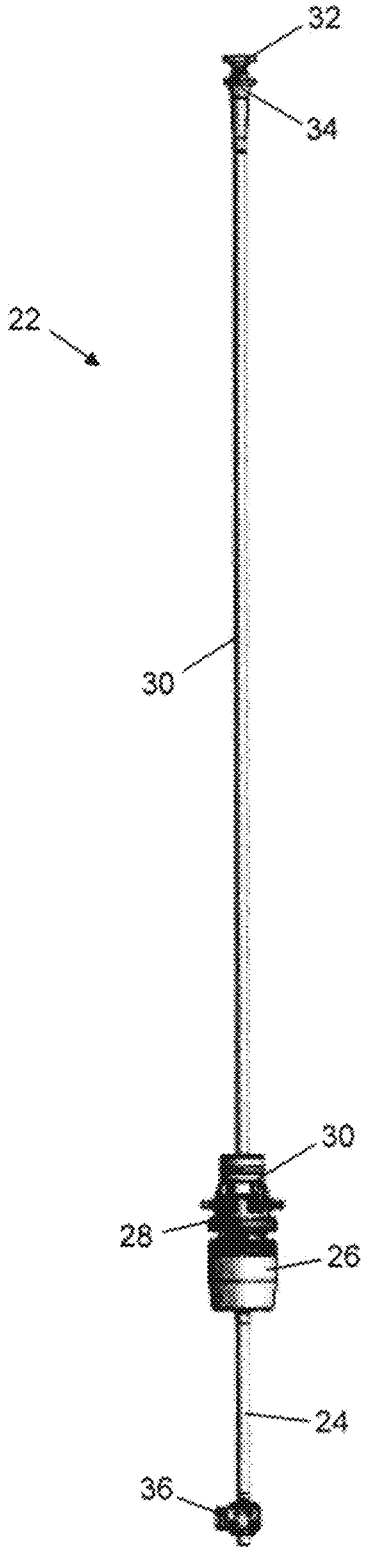
FIG. 2 is a side view of a riser top arrangement of the invention.
Figure 3:
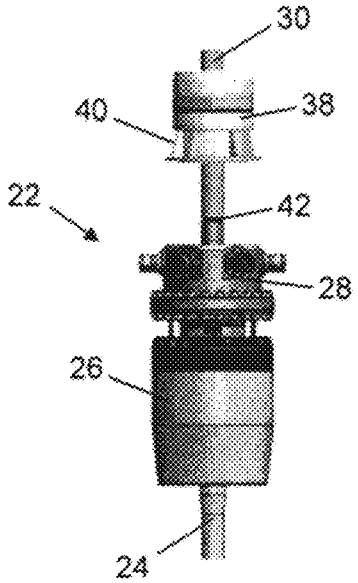
FIG. 3 is an enlarged side view of a pivot or joint combination of the arrangement shown in FIG. 2, comprising a bell joint in series with a flexible joint.
Figure 4:
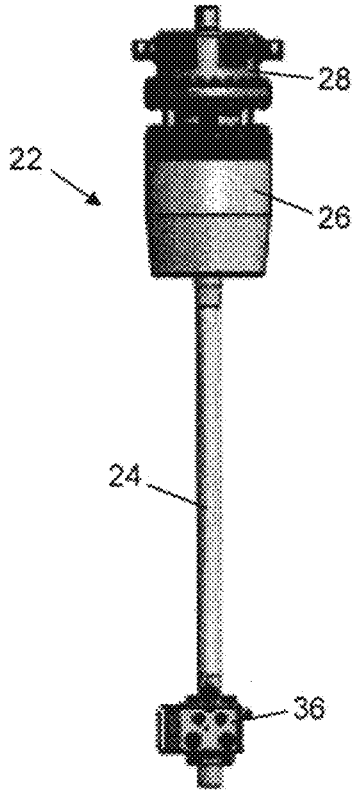
FIG. 4 is an enlarged side view of the pivot combination shown in FIG. 3, also showing an optional 'bishop hat' sleeve around an upper rigid pipe of the arrangement.

Referring next, then, to FIGS. 2 to 4 of the drawings, a riser top arrangement 22 of the invention comprises a longitudinal series of elements, namely, progressing upwardly: a lower rigid pipe section 24; a flexible joint 26; a ball joint 28 or bell connector surmounting the flexible joint 26 in series; and an upper rigid pipe section 30 being a rigid spool pipe, which may be up to about 30 m long, welded to the ball joint 28. In this example, flanged connections are made between each of those elements and the neighbouring element(s) in the series.

The upper end of the upper pipe section 30 comprises a flange 32, typically to an API specification. When this embodiment of the invention is positioned for use, a downwardly-tapering axial load-bearing formation 34 beneath the flange 32 engages with an upper balcony of a supporting structure to support the entire tension load of the catenary.

The tower end of the lower pipe section 24 is welded contiguously to the upper end of a steel catenary riser, effectively becoming integral with the riser which extends to, and includes, the flexible joint 26. An optional riser monitoring system 36 is shown in FIGS. 2 and 4.

A hollow sleeve 38 known in the art as a 'bishop hat' surrounds the upper pipe section 30 with substantial radial clearance defining an annular gap between them. As will be explained, the sleeve 38 is responsible for attaching the riser top arrangement 22 to the bellmouth 20, transferring bending moments to the upper pipe section 30.

The annular gap between the upper pipe section 30 and the sleeve 38 permits limited pivotal movement of the upper pipe section 30 about the ball joint 28. In this example, the upper pipe section 30 can pivot about the bell joint 28 by up to 15° from the central axis of the sleeve 38, hence being free to move relative to the other elements of the riser top arrangement 22 within an upwardly-diverging conical volume.

A skirt 40 at the bottom of the sleeve 38 is normally seated on top of the ball joint 28 as shown in FIG. 2. However, the sleeve 38 is shown lifted away from the ball joint 28 in FIG. 3 to show the weld 42 by which the upper pipe section 30 is attached to the ball joint 28. The skirt 40 of the sleeve 38 is surrounded by upwardly-tapering flanges that together impart a frusto-conical profile to the base of the sleeve 38.

Turning now to FIGS. 5 and 6, these drawings show the riser top arrangement 22 being pulled into and then engaged with the bellmouth 20 of an I-tube or J-tube.

In FIG. 5, the API flange at the top of the upper pipe section 30 is shown entering the bellmouth 20 during upward pull-in movement of the riser top arrangement 22. At this stage, the lower pipe section 24 and the upper pipe section 30 are substantially in mutual alignment via the flexible joint 26 and the ball joint 28, all at an angle of about 4° to the vertical.

In FIG. 6, the riser top arrangement 22 has been lifted up to the extent that the sleeve 38 has now engaged with the bellmouth 20. In this respect, the upwardly-tapering profile around the skirt 40 of the sleeve 38 serves as a mating formation for the sleeve 38 that complements the downwardly-flared profile of the bellmouth 20. In this way, the sleeve 38 mechanically connects the ball joint 28 and hence the remainder of the riser top arrangement 22 to an external support that is exemplified here by the bellmouth 20.

As noted above, engagement of the axial load area 34 of the upper pipe section 30 with an upper balcony 16 of a supporting structure supports the tension load of the catenary. By pulling upwardly on the riser top arrangement 22, this tension also holds the sleeve 38 in engagement with the bellmouth 20. The sleeve 38 and the bellmouth 20 then support the flexible joint 26 to absorb angular loads arising from deflection of the riser in operation. The ball joint 28 plays no part in handling these angular loads from the operational riser.

It will be noted in FIG. 6 that the upper pipe section 30 is now substantially vertical whereas the remainder of the riser top arrangement 22 matches the typical inclination of the top of the riser and the bellmouth 20, namely between about 7° and 9° from the vertical in this example. The ball joint 28 pivots to accommodate this relative angular displacement of the upper pipe section 30 within the confines of the surrounding sleeve 38.

FIGS. 7 and 8 and FIGS. 9 and 10 show the respective states of the ball joint 28 when the riser top arrangement 22 is in the straight and angled states shown in FIGS. 5 and 6.

FIG. 8 includes a detail view that shows that the outer face of the sleeve 38 comprises a tapered C-ring 44. The C-ring 44 is mounted on a rubber ring 46 to take up any clearance between the sleeve 38 and the I-tube that incorporates the bellmouth 20.

In the sectional views of FIGS. 7 and 8, it will be apparent that, as is conventional, the flexible joint 26 comprises an elastomeric element 48 that is sandwiched between part-spherical pivot formations 50. The flexible joint 26 contains a central tube 52 that effects fluid communication between the lower pipe section 24 and the ball joint 28.

Also, the flexible joint 26 is coupled to the ball joint 28 by a flange adaptor 54 that connects parallel flanges of the flexible joint 26 and the ball joint 28 to hold those structures together in face-to-face sealing contact.

The features of the ball joint 28 are best appreciated with reference to FIGS. 9 to 11.

FIGS. 9 and 10 show that the ball joint 28 comprises a hollow pivot element 56 surrounded by a ring structure 58. The ring structure 58 has an array of bores 60 on its upper side to receive bolts for flanged connection to the skirt 40 of the sleeve 38. The ring structure 58 surmounts a bottom flange 62 whereby the ball joint 28 is coupled to the flexible joint 26 using the aforementioned flange adaptor 54.

In this embodiment, the ball joint 28 has an optional locking mechanism. For this purpose, the ring structure 58 supports an angularly-spaced array of radially-movable dogs 64, shown here retracted radially in an unlocked configuration. By activating respective hydraulic dog cylinders 66 individually, the dogs 64 can be advanced in a radially-inward direction to the varying extents that may be necessary for them to bear against the pivot element 56 at one of its several orientations.

FIG. 11 shows that the pivot element 56 has a part-spherical base 68 in fluid communication with the central tube 52 of the flexible joint. FIG. 11 also shows that the base 68 of the pivot element 56 is received and retained in a complementary cavity within the ring structure 58. The cavity is defined by a guide insert 70 with part-spherical concave curvature. A sealant line 72 communicates with the cavity to admit a sealing fluid that forms a seal around the pivot element 56.

It will be apparent from FIG. 11 that the dogs 64 lie in a plane above the base 68 to bear against a narrower neck 74 of the pivot element 56. Working together, therefore, the dogs 64 can lock the pivot element 56 at any orientation relative to the ring structure 58. In this way, when the large pivot angle of the ball joint 28 has facilitated installation of the riser and installation is complete, the pivot element 56 of the ball joint 28 can be locked in an orientation matching that of the upper pipe section 30.

Locking the pivot element 56 of the ball joint 28 in this manner couples the upper pipe section 30 to the ball joint 28 and hence to the flexible joint 26 as a rigid system, strengthening the structure and avoiding further movement of the ball joint 28 that could induce fatigue. From that point onward, the only compliance in the system is that provided by the flexible joint 26, which conventionally supports the riser for cyclical movement during its operational life in a fatigue-resistant manner.

The upper pipe section 30 can be fitted offshore after the riser and flexible joint 26 has been installed on the surface facility. If the upper pipe section 30 is installed after the riser, the pivot element 56 and the guide insert 70 attached to the upper pipe section 30 can be inserted into the ring structure 58 and then locked by operating the dog cylinders 66. However, an advantage of the pivotable rigid upper section of the invention is to avoid the need for further connection because the rigid upper section can be passed through the tubes.

Finally, FIGS. 12 and 13 show that the riser top arrangement 22 of the invention can be applied not only to a balcony designed for a flexible riser but also to a hang-off structure 76 designed for a rigid riser. In this case, the flexible joint 26 is seated into the hang-off structure 76 as best appreciated in FIG. 13. This engagement with the hang-off structure 76 is facilitated by the downward taper of the housing of the flexible joint 26, which is evident from preceding drawings.

The top flange 32 of the upper pipe section seen in FIGS. 12 and 13 can be adapted for any type of connection to an upper balcony. The sleeve 38 is not required in this embodiment and so has been omitted.

Other variations are possible within the inventive concept. For example, a tapered stress joint could be used beneath the ball joint instead of a flexible joint.

The invention claimed is:

1. A top connection arrangement for a subsea riser, the arrangement comprising a pivot combination disposed between, and fluidly connecting, upper and lower pipe sections of rigid pipe, wherein the pivot combination comprises:

an upper ball joint to which the upper pipe section is attached and about which the upper pipe section is pivotable;

a sleeve that is fixed to the ball joint and that surrounds the upper pipe section, wherein an annular gap between the sleeve and the upper pipe section permits pivotal movement of the upper pipe section about the ball joint; and a lower joint fixed to the ball joint in series, the lower joint being a flexible joint or a tapered stress joint to which the lower pipe section is attached.

2. The arrangement of claim 1, wherein the sleeve limits further pivotal movement of the upper pipe section about the ball joint.

3. The arrangement of claim 1, wherein an outer face of the sleeve comprises an upwardly-tapering mating formation.

4. The arrangement of claim 1, wherein the ball joint is attached directly to the lower joint.

5. The arrangement of claim 1, further comprising a flange adapter that interconnects respective flanges of the ball joint and of the lower joint.

6. The arrangement of claim 1, wherein the upper pipe section comprises a load-bearing formation spaced longitudinally from, and tapering toward, the ball joint.

7. The arrangement of claim 1, wherein the ball joint comprises a locking mechanism that is capable of locking the ball joint against movement of the upper pipe section relative to the ball joint.

8. The arrangement of claim 7, wherein the locking mechanism comprises a circumferential array of dogs disposed around a central pivot element, the dogs being movable radially inwardly to engage the pivot element to lock the ball joint.

9. The arrangement of claim 8, wherein the dogs are movable radially inwardly to respectively different extents.

10. The arrangement of claim 1, when supported by a supporting structure of a surface facility.

11. The arrangement of claim 10, wherein the supporting structure comprises a hang-off formation in which the lower joint is seated.

12. The arrangement of claim 10, wherein the lower joint is engaged with the supporting structure via the ball joint.

13. The arrangement of claim 1, when supported by a supporting structure of a surface facility, the supporting structure comprising a tubular support defining a bellmouth in which the sleeve is received.

14. The arrangement of claim 13, wherein tension in the upper pipe section retains the sleeve in the bellmouth.

15. The arrangement of claim 10, when supporting a catenary-type riser of rigid or flexible pipe.

16. The arrangement of claim 15, wherein tension in the upper pipe section supports the suspended weight of the riser.

17. The arrangement of claim 10, wherein the upper pipe section is in fluid communication with pipework of the surface facility without an intermediate flexible conduit.

18. A surface facility supporting the arrangement of claim 10.

19. A method of connecting a subsea riser to a surface facility, the method comprising:

pulling in a top connection arrangement of the riser toward engagement with a supporting structure of the surface facility;

while pulling in, pivoting an upper rigid pipe section of the arrangement about an upper ball joint of the arrangement;

engaging a lower joint of the arrangement with the supporting structure, the lower joint being a flexible joint or a tapered stress joint fixed in series to the ball joint;

suspending the riser from the surface facility via a lower rigid pipe section of the arrangement that is attached to the lower joint engaged with the supporting structure; and effecting fluid communication between the upper rigid pipe section and pipework aboard the surface facility.

20. The method of claim 19, further comprising locking the ball joint to restrain further pivoting of the upper rigid pipe section.

21. The method of claim 19, comprising also pivoting the lower rigid pipe section about the lower joint while pulling in the arrangement.

22. The method of claim 19, comprising engaging the lower joint with a hang-off formation of the supporting structure.

23. The method of claim 19, comprising pulling the upper rigid pipe section into a tube and engaging the lower joint with a bellmouth of the tube.

24. The method of claim 23, comprising engaging the lower joint with the bellmouth via the ball joint.

25. The method of claim 24, comprising engaging the lower joint with the bellmouth via a sleeve attached to the ball joint.

26. The method of claim 25, comprising using the sleeve to limit pivotal movement of the upper rigid pipe about the ball joint.

27. The method of claim 23, comprising holding the lower joint in engagement with the bellmouth by tension in the upper rigid pipe section.

28. The method of claim 19, comprising engaging the upper rigid pipe section with a hang-off formation of the supporting structure.

29. The method of claim 28, comprising suspending the weight of the riser through the upper rigid pipe section.

* * * * *